United States Patent [19]

Sakamoto

[11] 4,062,178

[45] Dec. 13, 1977

[54] ELECTRONIC TIMEPIECE

[75] Inventor: Motoyoshi Sakamoto, Suwa, Japan

[73] Assignee: Kabushiki Kaisha Suwa Seikosha, Tokyo, Japan

[21] Appl. No.: 705,487

[22] Filed: July 15, 1976

Related U.S. Application Data

[63] Continuation-in-part of Ser. No. 462,554, April 19, 1974, abandoned.

[30] Foreign Application Priority Data

Apr. 19, 1973 Japan ..... 48-43647

[51] Int. Cl.[2] ..... G04B 27/08

[52] U.S. Cl. ..... 58/23 R; 58/85.5

[58] Field of Search ..... 58/23 R, 50 R, 85.5; 328/48

[56] References Cited

U.S. PATENT DOCUMENTS

| | | | |
|---|---|---|---|
| 3,540,207 | 11/1970 | Keeler | 58/23 R |
| 3,777,471 | 12/1973 | Koehler et al. | 58/23 R |
| 3,812,669 | 5/1974 | Wiget | 58/23 R |
| 3,895,486 | 7/1975 | Hammer et al. | 58/23 R |

*Primary Examiner*—Ulysses Weldon

*Attorney, Agent, or Firm*—Blum, Moscovitz, Friedman & Kaplan

[57] ABSTRACT

A frequency regulating circuit for an electronic timepiece is provided. The electronic timepiece includes an oscillator circuit for producing a high frequency time standard signal and a divider circuit for producing a low frequency timekeeping signal in response to the high frequency time standard signal being applied thereto. The divider circuit includes a plurality of series-connected divider stages, the frequency of the low frequency timekeeping signal being determined by the number of divider stages. Each divider stage is adapted to produce an intermediate frequency signal representative of the count thereof. The frequency regulating circuit is particularly characterized by a first logic circuit adapted to receive certain of said intermediate frequency signals produced by the divider stages and in response to a coincident binary state of the intermediate frequency signals applied thereto, apply a control signal to each of the divider stages to adjust the count of each of the divider stages to the same binary state. A gating circuit is coupled intermediate each of the divider stages and the logic circuit and is adapted to select the manner in which certain of the intermediate frequency signals are applied to the logic gate and thereby regulate the frequency of the low frequency timekeeping signal.

6 Claims, 10 Drawing Figures

ELECTRONIC TIMEPIECE

CROSS REFERENCE TO RELATED APPLICATIONS

This application is a Continuation-in-Part application of parent application Ser. No. 462,554, now abandoned.

BACKGROUND OF THE INVENTION

This invention relates generally to electronic timepiece frequency regulating circuits, and in particular, to effecting regulations of the low frequency timekeeping signal without varying the frequency of the high frequency time standard signal produced by the oscillator circuit.

Heretofore, timepieces of the mechanical variety having a balance wheel oscillator and electronic timepieces having either tuning fork or quartz crystal oscillator circuits have been difficult to adjust when optimum accuracy is required. In each type of timepiece, the adjustment is made directly to the vibrating time standard. Thus, when a quartz crystal oscillator circuit is utilized, the oscillating frequency of the oscillator circuit is regulated by inserting a variable capacitor into the oscillator circuit and changing the value of the capacitor in order to adjust the resonant frequency of the oscillator circuit. Alternatively, the vibrator itself, e.g., balance wheel, tuning fork, quartz oscillator or the like, is altered or means are added thereto to change the frequency at which some vibrates. Such methods of regulating the high frequency time standard signal produced by the oscillator circuit have been found to be less than completely satisfactory.

It is noted that when additional circuit elements and/or mechanical elements are added to a vibrator, the stability of the oscillator circuit is reduced. Additionally, since the resonant frequency must be selected within narrow limits to permit regulation thereof, the manufacturing of the time standards utilized in the oscillator circuit require constant attention and high precision, thereby increasing the manufacturing costs of the electronic timepieces utilizing such time standards. Accordingly, it is desired to include a frequency regulating circuit in an electronic timepiece for varying the division ratio of the divider circuitry to thereby regulate the frequency without affecting the oscillator circuit.

SUMMARY OF THE INVENTION

Generally speaking, in accordance with the invention, improved frequency regulating circuitry for an electronic timepiece is provided. The electronic timepiece includes an oscillator circuit for producing a high frequency time standard signal and a divider circuit for producing a timekeeping signal in response to the high frequency time standard signal. The divider circuit includes $n$ series-connected divider stages, the frequency of the timekeeping signal being determined by the number $n$ of series-connected divider stages. Each of the divider stages is adapted to produce an intermediate frequency signal representative of the count thereof. The frequency regulating circuit is coupled to the divider circuit in order to selectively regulate the frequency of the low frequency timekeeping signal and includes a first logic gate for receiving either an intermediate frequency signal, or an inverted intermediate frequency signal from each of the $n$ series-connected divider stages and in response to each of the frequency signals applied thereto having a coincident state, being adapted to apply a control signal to each of the $n$ series-connected divider stages to change the count thereof to the same predetermined binary state. The frequency regulating circuit further includes a gating circuit disposed intermediate each of the divider stages and the logic gate for selectively inverting certain of the intermediate frequency signals and applying same to the logic gate and further applying the remaining intermediate frequency signals to the logic gate. The gate circuit is adapted to apply the intermediate frequency signals produced by $k$ series-connected divider stages, where $k = 0, 1, 2 \ldots n-1$, and to invert the series-connected divider stages produced by $n-k+1$ divider stages.

Accordingly, it is an object of this invention to provide a small-sized electronic timepiece having frequency regulating circuitry for varying the frequency of the timekeeping signal without having to tune the oscillator circuit.

A further object of this invention is to provide an improved electronic timepiece wherein the timekeeping thereof is regulated by regulating the count of each of the divider stages once during each period of the low frequency timekeeping signal.

Still a further object of the invention is to provide an improved electronic timepiece wherein the stability of the oscillator circuit is unaffected by frequency regulation.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
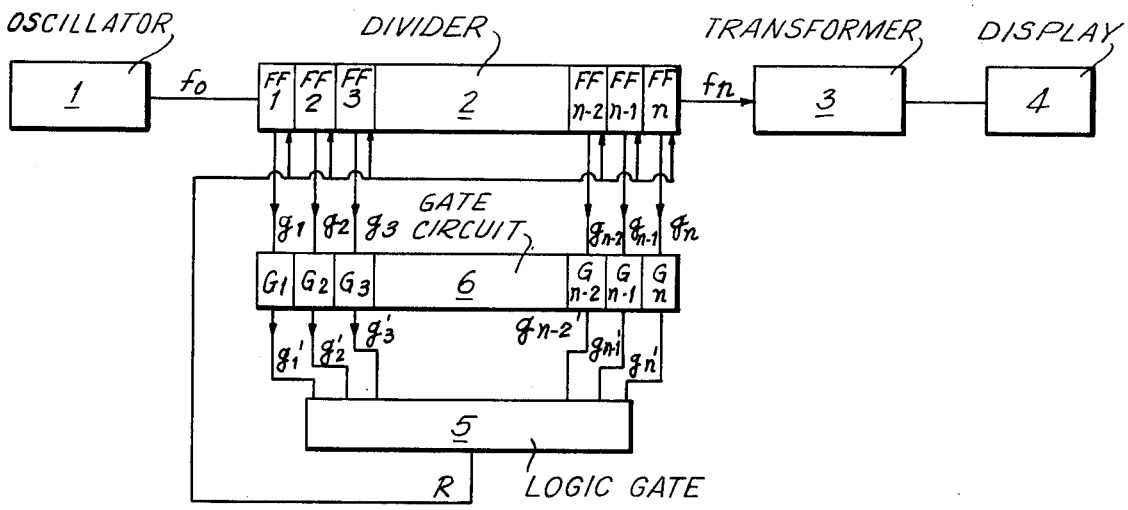
FIG. 1 is a block circuit diagram of an electronic timepiece frequency regulating circuit constructed in accordance with a preferred embodiment of the instant invention.

Reference is now made to FIG. 1, wherein an electronic timepiece including a frequency regulating circuit constructed in accordance with a preferred embodiment of the instant invention is depicted. An oscillator circuit 1 having a conventional time standard such as a quartz crystal vibrator or the like is adapted to produce a high frequency time standard signal $f_0$, which signal is applied to a divider circuit 2. The divider circuit 2 is formed of a plurality of series-connected binary divider stages $FF_1$–$FF_n$ and divides the high frequency time standard signal into a low frequency timekeeping signal $f_n$ having a predetermined period of one second. The timekeeping signal is applied to a transformer 3, such as a stepping motor, which, in turn, rotates the display elements including a drive train in a mechanical timepiece. Alternatively, if the display 4 is a conventional 7-segmented digital display formed of light-emitting diodes or liquid crystals, the transformer circuit 3 would then include further frequency divider circuits for dividing the high frequency time standard signal to the frequencies required for the time display by each display element such as seconds, minutes, dates and days of the week, and would further include decoder and driving circuitry for converting the signals counted by the additional divider circuits into the signals to be applied to the respective 7-segmented display digits. As is detailed below, the frequency regulating circuitry of the instant invention is directed to regulating the frequency produced by the divider circuitry, and hence is not limited to a particular type of oscillator circuit or a particular type of display.

The divider 2 can be formed from any conventional divider circuitry such as shift registers, decimal counters or the like. Nevertheless, in order to facilitate the explanation herein, the divider stages $FF_1$–$FF_n$ illustrated in FIGS. 1, 2, 5 and 7 are comprised of binary flip-flops and are normally referenced at 0 at the beginning of each cycle if the divider is selected to count in an addition mode or are normally referenced to 1 at the beginning of each cycle if the divider is counting in a subtraction mode. For example, when the divider is counting in an addition mode, each of the dividers $FF_1$–$FF_n$ are referened to a 0 binary state and at the completion of the counting cycle are each referenced to a "1" binary state, whereafter each of the flip-flops $FF_1$–$FF_n$ are returned to the 0 state to once again being the next counting cycle.

Coupled to each of the binary flip-flop stages $FF_1$–$FF_n$ is a gate circuit 6, having gates $G_1$–$G_n$ corresponding respectively to each flip-flop stage $FF_1$–$FF_n$ in divider circuit 2. The respective gate circuits $G_1$–$G_n$ are adapted to receive the intermediate frequency signals produced by the binary flip-flops $FF_1$–$FF_n$ and depending on the selected manner of frequency adjustment apply as inputs to $g_1'$–$g_n'$ to logic gate 5 each of the intermediate frequency signals $g_1$–$g_n$, some of the intermediate frequency signals $g_1$–$g_n$, or all of the intermediate frequency signals $g_1$–$g_n$, with certain of such intermediate frequency signals inverted. Accordingly, the inputs $g_1'$ through $g_n'$ to the logic gate 5 correspond to each of the inputs $g_1$–$g_n$ to the gate circuits $G_1$–$G_n$. Logic gate 5 is coupled to each of the binary flip-flop divider stages $FF_1$–$FF_n$ and divider circuit 2 to apply a controlsignal R thereto. As will be explained in greater detail below, the control signal R is either a reset signal for resetting each of the divider stage flip-flops $FF_1$–$FF_n$ to a 0 binary state or alternatively is set-to-one signal for setting each of the divider stage flip-flops $FF_1$–$FF_n$ to a 1 binary state.

In operation, if the logic gate 5 is an NOR gate and the divider circuit 2 operates in a subtraction counting mode, each binary divider stage is set at 1 at the beginning of each period of the timekeeping signal and a high frequency time standard signal $f_0 \leqq 2^n$ Hz is applied by the oscillator circuit 1 to the divider circuit 2. Divider circuit 2 divides the high frequency time standard $f_0$ into a low frequency timekeeping signal $f_n$, which for purposes of explaining the instant invention $\geqq 1$ second. If the logic gate 5 is a NOR gate, gates $G_1$–$G_n$ of the gate circuit 6 are adapted to selectively apply selected one's of the binary divider intermediate frequency signals $g_1$–$g_n$ to logic gate 5 as a corresponding group of signals $g_1'$–$g_n'$. When the binary states of each of the signals $g_1'$–$g_n'$ applied to the logic gate 5 are coincident, the logic gate (NOR gate) applies a single reset pulse to each of the divider stage flip-flops $FF_1$–$FF_n$ to thereby effect a setting to one or all of the divider stages $FF_1$–$FF_n$. In response to the next leading edge edge of the high frequency time standard signal, after each of the divider stages has been set to 0, each of the divider stages are switched to 1 to thereby commence counting of another counting cycle.

Figure 5:
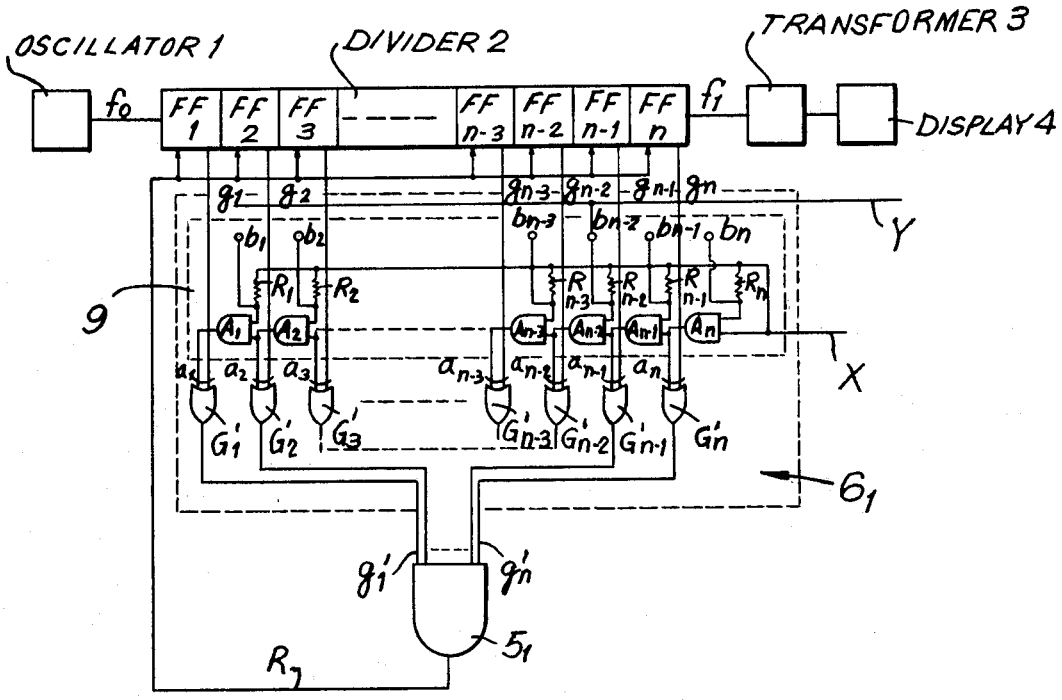
FIG. 5 is a detailed circuit diagram of a first embodiment of the gate circuit depicted in FIG. 1.

If frequency regulation, according to the circuit depicted in FIG. 1, is to be effected, one of several approaches can be utilized. The gates $G_1$–$G_n$ of the gating circuit can select certain of the intermediate frequency signals and reference the remaining inputs of the logic gate 5 to a "0" binary state when the logic gate is a NOR gate, as is illustrated in the embodiment depicted in FIG. 7, or alternatively, the gates $G_1$–$G_n$ can invert certain of the intermediate frequency signals produced by the divider stages and apply the remaining intermediate frequency signals to the logic gate 5 when the logic gate 5 is a AND gate as is illustrated in FIG. 5. As is demonstrated in detail below, the type of gating circuit and logic gate 5 determine the manner in which the intermediate frequency signals are applied to the logic gate 5 and further determine the amount of frequency regulation to be effected.

Figure 7:
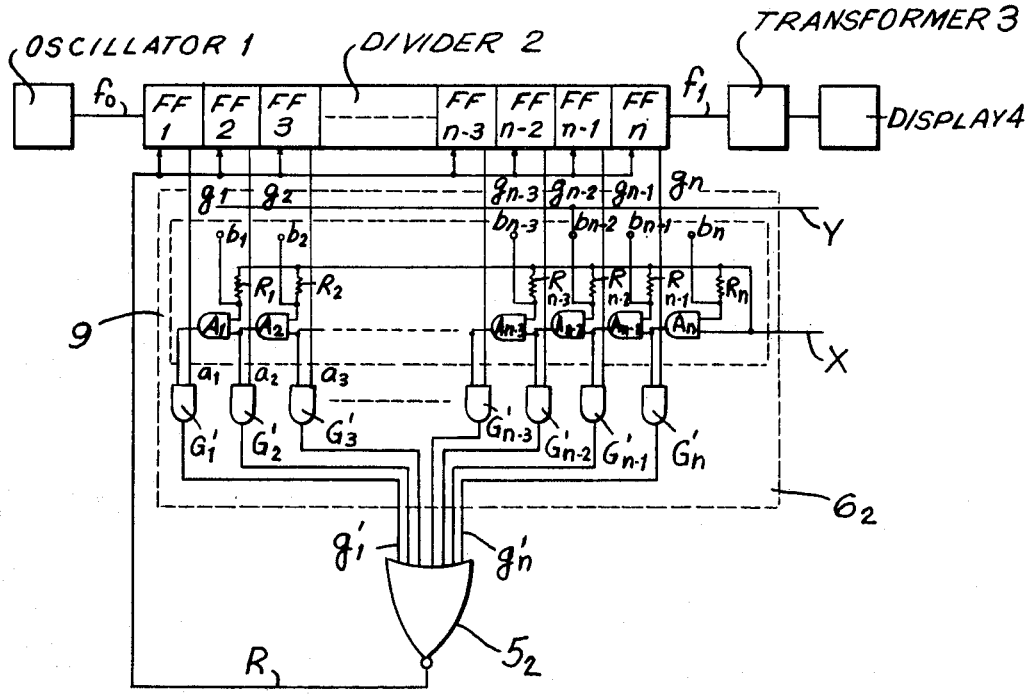
FIG. 7 is a detailed circuit diagram of a further embodiment of the gate circuit depicted in FIG. 1.

By way of example, when a timekeeping signal counted by the divider circuit is a retarded signal having a period $t_1$ greater than one second, then the period $t_1$ counted thereby is actually $t_1 = 1 + \Delta T$ seconds. Since it is desired for $f_n$ to have an actual period of 1 second, the timekeeping signal is adjusted by determining which divider stages can be set to 1 just prior to the end of each period to thereby omit a portion of the timekeeping signal $f_n$ and thereby adjust the period of the signal $f_n$ once each period. Moreover, the amount which the signal is to be adjusted, $$\Delta T = \frac{1}{f_0} \sum_{i=0}^{i=k-1} 2^i$$

wherein $k = 1, 2, \ldots n-1$ and $k$ corresponds to the number of binary divider stages, $FF_1$–$FF_n$, the output signals of which are not applied to the logic gate 5 when the logic gate in a NOR gate, as depicted in FIG. 7. Accordingly, for one embodiment of the invention depicted in FIG. 1, a plurality of gates $G_1$–$G_n$ prevents the intermediate frequency signals applied thereto from being applied to the logic gate 5 and instead, if the logic gate is a NOR gate, applies a zero thereto. The remaining inputs to the NOR gate 5 selected by gates $G_{(n-k+1)}$–$G_n$ are the intermediate frequency signals produced by the remaining divider stage flip-flops $FF_{(n-k+1)}$–$FF_n$. Thus, if the divider stages $FF_{(n-k+1)}$–$FF_n$ apply their output signals to the logic (NOR) gate 5 through gates $G_{(n-k+1)}$–$G_n$, the amount which the high frequency signal $f_0$ is reduced equals $\Delta T$ to thereby yield a low frequency timekeeping signal $f_n$ having a period equal to 1 second. The above described frequency regulation is explained hereinafter with respect to detailed examples of the gate circuit 6 and logic gate 5 for obtaining such frequency regulation.

Reference is now made to FIG. 5, wherein a first embodiment of the gating circuit 6 illustrated in FIG. 1, is generally indicated as $\mathbf{6}_1$, like reference numerals being utilized to denote like elements depicted in FIG. 1. It is noted that the logic gate 5 illustrated in FIG. 1 is an AND gate, illustrated in FIG. 5 as $\mathbf{5}_1$ and having the output thereof coupled to the reset terminal of each of the divider stages $FF_1$–$FF_n$ to effect a resetting to 0 of each of the divider stages in response to the control signal R being applied thereto.

The gating circuit $\mathbf{6}_1$ includes gates $G_1$–$G_n$, which gates are EXCLUSIVE OR gates having the outputs thereof, $g_1'$–$g_n'$, applied as the inputs to the AND gate $\mathbf{5}_1$. A first input to each of the EXCLUSIVE OR gates $G_1$–$G_n$ are the intermediate frequency signals $g_1$–$g_n$ produced by the respective divider stages $FF_1$–$FF_n$. The second input of each of the EXCLUSIVE OR gates $G_1$–$G_n$ are respectively coupled to the outputs of AND gates $A_1$–$A_n$, which AND gates comprise a gate selecting circuit 9. The gate selecting circuit 9 is adapted to reference the second input $a_1$–$a_n$ of the EXCLUSIVE OR gates $G_1$–$G_n$ to a 1 or 0 binary state to thereby determine whether an intermediate frequency signal produced by the divider stage, or alternatively, an inverted intermediate frequency signal produced by the divider stage, is applied to the inputs $g_1'$–$g_n'$ of the AND gate $\mathbf{5}_1$. In addition to being coupled to the second input $a_1$–$a_n$ of each of the EXCLUSIVE OR gates, the output of each of the AND gates $A_2$–$A_n$ is coupled to the input of the AND gate associated with the next-previous divider stage. For example, the output of the AND gate $A_{n-1}$ is coupled not only to the second input $a_{n-1}$ of the EXCLUSIVE OR gate $G_{n-1}$, but is additionally coupled to a first input of the AND gate $A_{n-2}$. The other input of each AND gate $A_1$–$A_n$ is respectively coupled through a resistor $R_1$–$R_n$ to a common terminal, which terminal is further coupled to a reference potential X. Additionally, select terminals $b_1$–$b_n$ are coupled intermediate each of the resistors $R_1$–$R_n$ and the respective inputs of the AND gates $A_1$–$A_n$ to which same are coupled. As is illustrated in FIG. 5, by merely coupling one select terminal, such as select terminal $b_{n-2}$ to the reference terminal Y, which terminal is referenced to a 0 binary level, selection of each of the intermediate frequency signals to be applied to the AND gate $\mathbf{6}_1$ and selection of each of the intermediate frequency signals to be inverted and then applied to the intermediate frequency signal is effected. Accordingly, by mechanically coupling a select terminal by hard wiring same, or alternatively by utilizing appropriate electronic switches or the like, effective frequency regulation is obtained by coupling a single select terminal $b_1$–$b_n$ of the 0 level reference terminal Y.

The operation of the frequency regulation circuit described and depicted above in FIG. 5 is as follows. When the low frequency timekeeping signal $f_n$ is retarded, and hence has a period greater than 1 second, the period thereof $t_1$ is equal to $1 + \Delta t$ seconds. In accordance with the above noted formula:

$$\Delta T = \frac{1}{f_0} \sum_{i=0}^{i=k-1} 2^i$$

where $k-1, 3 \ldots, n-1$, and $k$ equals the number of divider stages producing intermediate frequency signals that are not to be inverted by the gates $G_1$–$G_k$ in order to reduce the low frequency timekeeping signal $f_n$ to period $t_1$ of exactly 1 second.

The divider circuit depicted in FIG. 5 is a substraction mode (count-down) divider, and therefore each divider stage is set to a binary count of 1 at the beginning of each period and is at a binary count of 0 at the end of each counting cycle. Accordingly, once the amount $\Delta t$ that the low frequency timekeeping signal is greater than one second is determined by the above noted formula, the value $k$ is determined, which value selects the number of intermediate frequency signals not to be inverted by the gates $G_1$–$G_k$. Accordingly, if $k = 3$, then the inputs $a_1$–$a_k$ to the EXCLUSIVE OR gates $G_1$–$G_k$ are referenced to a 0 binary state, thereby permitting the intermediate frequency signals respectively applied to each of the EXCLUSIVE OR gates to be applied to the inputs $g_1'$–$g_k'$ of AND gate $\mathbf{5}_1$ without being inverted. Additionally, each of the inputs $a(_{k+l})$ through an of the EXCLUSIVE OR gates $G(_{k+l})$ through $G_n$ are referenced to a 1 binary state to thereby effect an inversion of the intermediate frequency signals produced by the divider stages $FF(k-1+_{FFn}$, respectively. Accordingly, the number $k$ refers to the number of gates that permit the intermediate frequency signals produced by the divider stages $FF_1$-$FF_k$ to be applied to the inputs $g_1'$–$g_k'$ of the AND gate $\mathbf{5}_1$. Accordingly, when each of the non-inverted intermediate frequency signals $g_1'$–$g_k'$ applied to the inputs of the AND gate $\mathbf{5}_1$ and each of the inverted intermediate frequency signal inputs $g'(_{k+l})$–$g_n'$ are in a binary 1 state, a control signal R is applied to each of the reset terminals of the flip-flops $FF_1$-$FF_n$ to thereby reset same to a 0 binary count. As noted above, since the divider circuit 2 is a subtraction mode or count-down circuit, each of the divider stages are referenced to a 0 binary count at the end of each period of the low frequency timekeeping signal $f_n$ and in response to the next rising leading edge of the high frequency time standard signal $f_0$ each of the divider stages is set to a binary count of 1 and begins the next counting cycle.

The gate selecting circuit 9 references the inputs $a_1$–$a_k$ of the EXCLUSIVE OR gates $G_1$–$G_k$ to a low or 0 binary level and the inputs $a(_{k+l})$–$a_n$ of the EXCLUSIVE OR gates $G(_{k+l})$–$G_n$ to a 1 binary level by coupling a single select terminal $b_k$ to the negative or low Y terminal, in the manner described above. Specifically, by coupling a first input of the AND gate $A_k$ to a 0 binary level, the input $a_k$ of the EXCLUSIVE OR gate $G_k$ and the input to the next AND gate $A_{k-1}$ are both referenced to a 0 or low binary state, thereby causing each of the inputs $a_1$–$a_k$ of the EXCLUSIVE OR gates $G_1$–$G_k$ to be referenced to a 0 binary state, and in turn causing the intermediate frequency signals applied to the other input of the EXCLUSIVE OR gate to be applied as non-inverted signals. The remaining resistors $R(_{k-l})$–$R_n$ are sufficient to reference the remaining inputs of the AND gates $A(_{k-l})$–$A_n$ to a high or 1 binary level, and thereby apply a 1 binary level to the inputs $a(_{k-l})$–$a_n$ of the EXCLUSIVE OR gates $G(_{k-l})$–$G_n$. The gate selecting circuit is thereby characterized by being a non-volatilized memory by coupling a single select terminal to a negative potential.

Figures 6A, 6B:
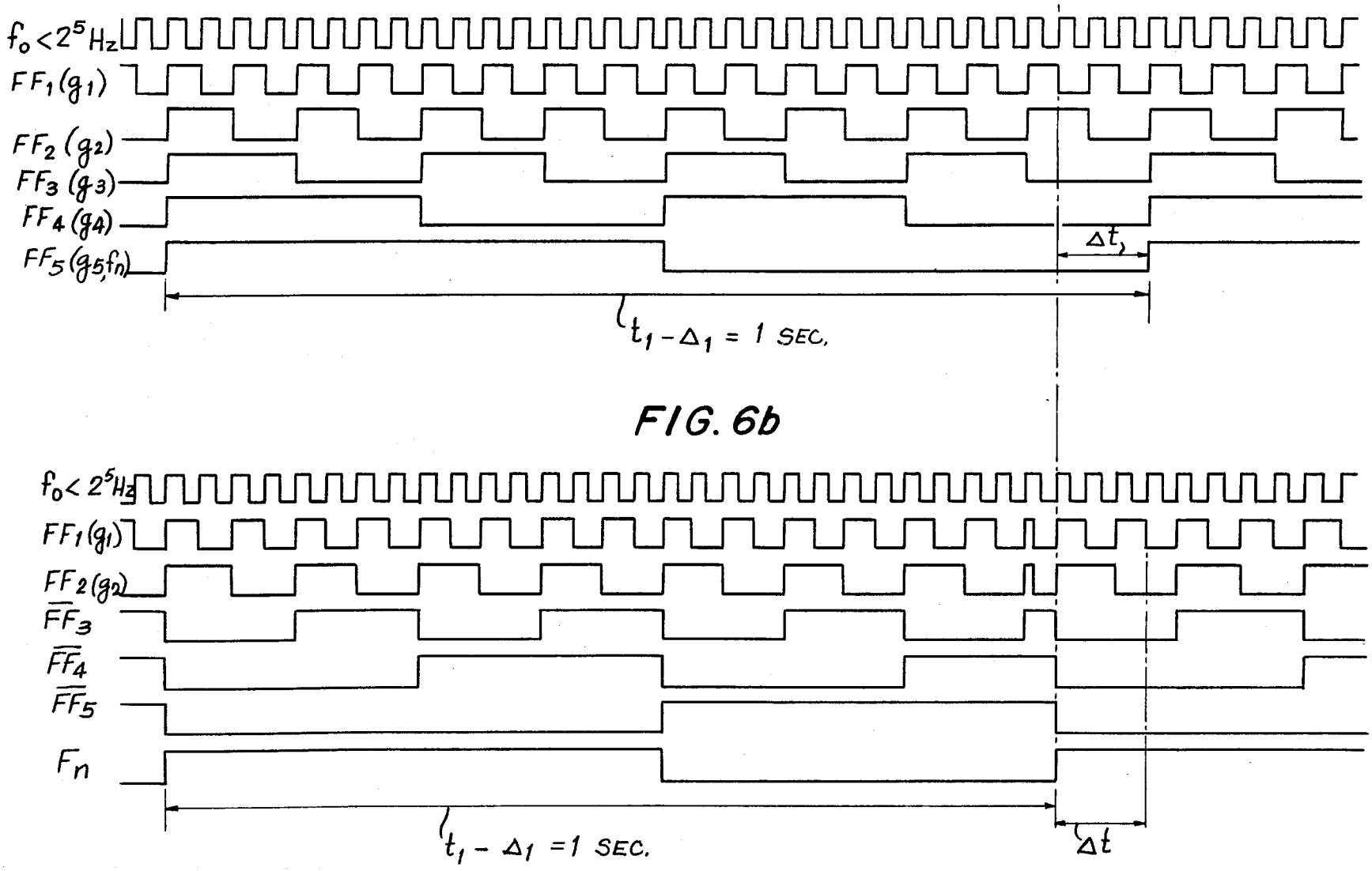
FIGS. 6*a* and 6*b* are wave diagrams illustrating the operation of the gate circuit depicted in FIG. 5.

Reference is now made to FIGS. 6*a* and 6*b* wherein wave diagrams illustrating the operation of a 5-stage divider circuit constructed in accordance with the circuit depicted in FIG. 5 is depicted. Although electronic timepieces utilizing quartz crystal vibrators produce high frequency time standard signals on the order of $2^{15}$ and $2^{16}$Hz, in order to simplify the illustration presented in FIGS. 6*a* and 6*b*, a simple divider having $n$ divider stages, where $n = 5$, and having a retarded high frequency time standard signal $f_0 < 2^5$ $H_z$ is depicted. Thus, if $f_0$ is less than $2^5$, then, $t_1 = 1 + \Delta t$ seconds. Accordingly, for the example depicted in FIGS. 6*a* and 6*b*, if $\Delta t = 3/32$, in order to obtain a 1 second signal is necessary to reduce the period $t_1$ by 3/32 thereof, and accordingly, $k$, the number of gates not inverted would number 2 ($k = 2$).

Thus, for the example depicted in FIG. 5, when $n = 5$, and $k = 2$, the select terminal $b_2$ is coupled to the Y terminal, thereby referencing inputs $a_1$ and $a_2$ to the EXCLUSIVE OR gates $G_1$ and $G_2$ to 0 to apply the intermediate frequency signals $g_1$ and $g_2$ produced by flip-flops $FF_1$ and $FF_2$, to the inputs $g_1$ and $g_2$ of the AND gate $\mathbf{5}_1$. The remaining inputs $a_3$–$a_5$ of the EXCLUSIVE OR gates $G_3$–$G_5$ are referenced to a 1 binary level and accordingly invert the intermediate frequency signals produced by flip-flops $FF_3$–$FF_5$ and apply same to the inputs $G_3'$–$G_5'$ of the AND gate $\mathbf{5}_1$, which inputs are represented as inverted intermediate frequency signals $\overline{FF}_3$, $\overline{FF}_4$ and $\overline{FF}_5$ in FIG. 6*b*. Accordingly, at a time 4/32 of period $t_1$, each of the inputs $G_1'$–$G_n'$ applied to the AND gate $\mathbf{5}_1$ is at a binary 1 or high level, and accordingly, the AND gate produces a control signal R, which control signal is applied to each of the flip-flops $FF_1$–$FF_5$ and resets each of the flip-flops to a 0 or low binary level and in response to the next rising leading edge of the high frequency time standard signal $f_0$, which rising leading edge occurs 3/32 of the period $t_1$, before the end of $t_1$ each of the divider stages $FF_1$–$FF_5$ is switched to a 1 or high binary level to thereby commence the next subtraction mode counting cycle. Thus, the uncorrected low frequency timekeeping signal $f_n$ having a period $t_1$ that exceeds one second by $\Delta t$, is reduced to a period $t_1'$ illustrated in FIG. 6*b*, said correction occurring once for each period of the timekeeping signal $f_n$ produced by the divider circuit.

Reference is now made to FIG. 7, wherein a further embodiment of the frequency regulating circuit depicted in FIG. 1 is depicted, like reference numerals being utilized to denote like elements depicted in FIGS. 1 and 5. The frequency regulating circuit depicted in FIG. 7 effects frequency regulation by preventing certain of the intermediate frequency signals from being applied to the logic gate, which logic gate is a NOR gate $\mathbf{5}_2$ and further applies the remaining intermediate frequency signals to the NOR gate to effect the application of a control signal to each of the divider stages when the intermediate frequency signals selected are at a 0 binary level. In order to change the manner in which frequency regulation is effected, the gates $G_1$–$G_n$ are formed of AND gates, and the logic gate, as noted above, is formed of a NOR gate $\mathbf{5}_2$.

Operation of the frequency regulating circuit depicted in FIG. 7 is similar to the frequency regulating circuit depicted in FIG. 5. Accordingly, when the period of the high frequency time standard signal $t_1 = 1 + \Delta t$, where $$\Delta T = \frac{1}{f_0} \sum_{i=0}^{i=k-1} 2^i$$

where $k = 1, 2, \ldots, n < 1$, and $k$ represents the number of gates $G_1$–$G_n$ that are closed i.e., prevent the application of an intermediate frequency signal to the input of the NOR gate $\mathbf{5}_2$. Accordingly, once the amount $\Delta t$ that the period of the high frequency time standard signal is delayed is determined, the value $k$ is readily obtained and the inputs $a_1$ through $a_k$ of the AND gates $G_1$–$G_k$ are referenced to a 0 binary level, and thereby cause the AND gates $G_1$–$G_k$ to apply a 0 level binary signal to the inputs $g_l'$–$g_k'$ during the entire frequency cycle of the timekeeping signal. Additionally, the inputs $a(_{k+l})$–$a_n$ of the AND gates $G(_{k+l})$–$G_n$ are referenced to a binary 1 to thereby apply the intermediate frequency signal $G(_{k+l})$–$G_n$ to the inputs $g'(k+1)$–$g_n'$ NOR gate $\mathbf{5}_2$. Accordingly, if the divider 2 is a subtraction mode or count-down divider, in response to the binary level of each of the intermediate frequency signals applied to the NOR gate $\mathbf{5}_1$ being at a 0 binary level, a control signal R is applied to each of the divider stages $FF_1$–$FF_n$ to reset the count thereof to zero, whereafter, upon the next rising leading edge of the high frequency time standard signal $f_0$, each of the divider stages $FF_1$–$FF_n$ is switched to 1 to thereby begin a further counting cycle.

Figure 3A:
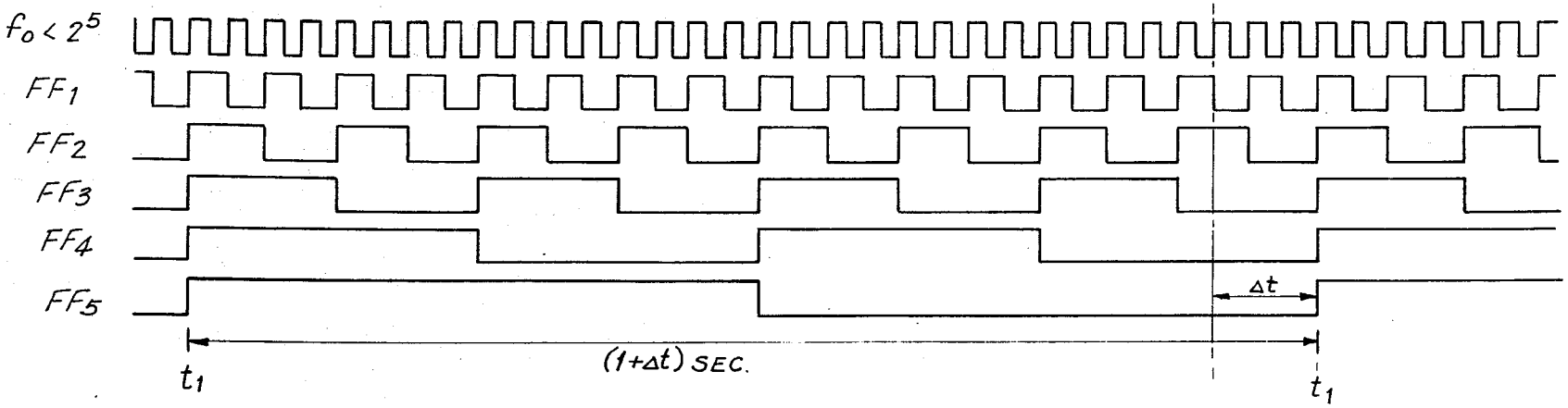
FIGS. 3*a* and 3*b* are wave diagrams illustrating the operation of the frequency regulating circuit depicted in FIG. 7.
Figure 3B:
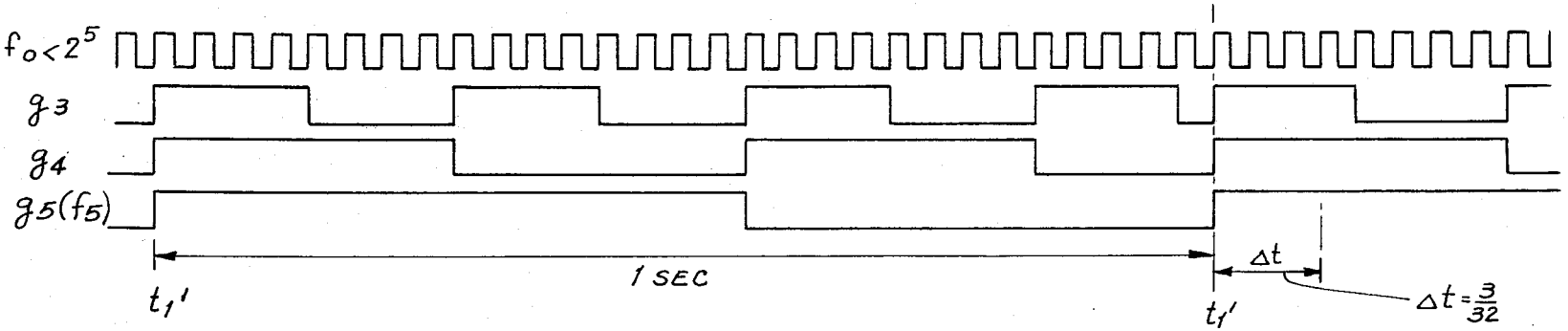

Reference is now made to FIGS. 3*a* and 3*b*, wherein a wave diagram illustrative of a simplified embodiment of the frequency regulating circuit depicted in FIG. 7 is illustrated. As in the wave diagrams illustrated in FIGS. 6*a* and 6*b*, the drivider 2 is formed of five frequency divider stages $FF_1$–$FF_5$ and in response to receiving a high frequency time standard signal $f_0$ having a frequency less than $2^5$ Hz produces a low frequency timekeeping signal $f_n$ having a period $t_1$ equal to $1 + \Delta t$. The example depicted in FIGS. 3*a* and 3*b* illustrates frequency regulation when $\Delta t = 3/32$ of the period $t_1$. In accordance with the above-noted formula, if $\Delta t = 3/32$, then $k = 2$. For the embodiment depicted in FIG. 7, the value $k$ represents the number of intermediate frequency signals that are prevented from being applied to the input of the NOR gate $\mathbf{5}_2$. Accordingly, by coupling the select terminal $b_2$ to the Y terminal, the AND gates $A_1$ and $A_2$ of the gate selecting circuit are referenced to a 0 binary state, and thereby prevent the intermediate frequency signals produced by the divider stages $FF_1$ and $FF_2$ from being applied as inputs $g_1'$ and $g_2'$ to the NOR gate $\mathbf{5}_2$. Instead, the inputs $g_1'$ and $g_2'$ are maintained at a 0 binary level.

Accordingly, as is specifically illustrated in FIG. 3*b*, only the intermediate frequency signals $g_3$, $g_4$ and $g_5$ are applied through the AND gates $G_3$–$G_5$ to the inputs $g_3'$–$g_5'$ of the NOR gate $\mathbf{5}_2$. When each of the intermediate frequency signals $g_3$–$g_5$ are in a coincident 0 binary state, the NOR gate $\mathbf{5}_2$ applies the control signal R to each of the divider stages $FF_1$–$FF_5$ to thereby reset each of the divider stages to a 0 binary level. In response to the next rising leading edge of the high frequency time standard signal $f_0$, each of the divider stages $FF_l$–$FF_n$ are switched to a 1 binary count to thereby begin the next counting cycle and thereby reduce the period $t_1$ by 3/32 thereof.

It is noted that it is not necessary to apply the above mentioned correction to all of the divider stages but instead to only a portion thereof. For example, the dividing effected by the divider circuit can be omitted by a portion equal to "$l$" stages. Regulation would then be prevented between 0 to ½ seconds and instead would be between ½ to $$\left(\frac{1}{2}+\frac{1}{f_0}\sum_{i=0}^{i=l-1} 2^i\right)$$

wherein $l = 1, 2 \ldots, n-1$. It is further noted that although $f_n$ is shown to be 1 second, the invention is not limited to adjustments at that frequency but instead is merely directed to shortening the period of the timekeeping signal by omitting a portion of the timekeeping signal counted by the divider circuit at the end of each period thereof.

Figure 2:
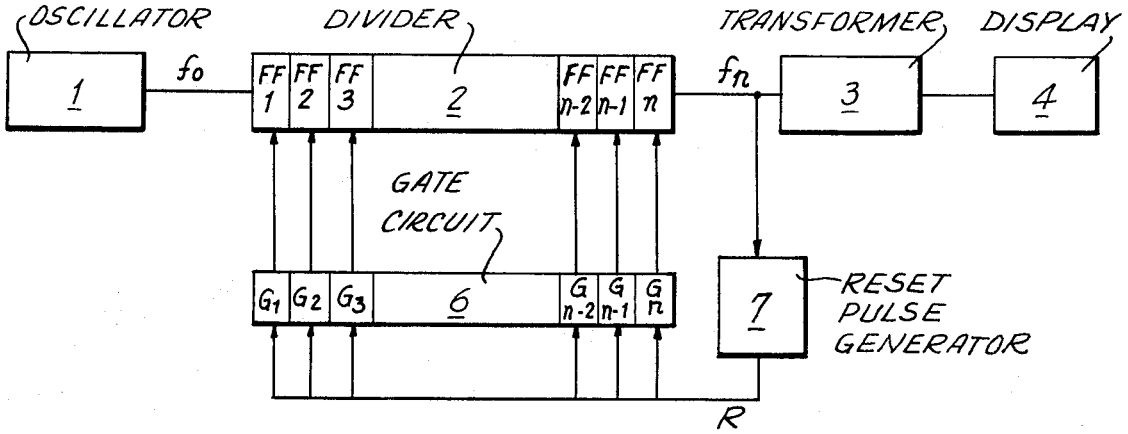
FIG. 2 is a block circuit diagram of an electronic timepiece frequency regulating circuit constructed in accordance with an alternate embodiment of the instant invention.

Reference is now made to FIG. 2, wherein an alternate embodiment of the instant invention is depicted and the adjustment of the timekeeping signal is achieved by omitting the first portion of the timekeeping signal $f_1$ for each period thereof, like numerals being utilized to denote like elements depicted in FIG. 1. The circuit of FIG. 2 includes a post-generator circuit 7 adpated to apply a reset signal to each gate $G_1$–$G_n$ of gate circuit 6, which gate circuit is adapted to apply a reset signal to each of selected one's of divider stages $FF_1$–$FF_n$ of divider circuit 2.

In operation, the pulse generator 7 is adapted to apply a reset signal to divider circuit 2 at the beginning of each period of the one second timekeeping $f_n$ to thereby cause a reset pulse to be generated. Once the timing error is determined, the gate circuits $G_1$–$G_n$ are selectively opened and closed, to effect selective gating of said reset signal to the respective divider stages coupled to gate circuits $G_1$–$G_n$, to thereby selectively reset the divider stages having said reset signals applied thereto in response to said reset signal. Like the circuit discussed in FIG. 1, the amount of error $\Delta t$ can be compensated for by selecting certain of the binary divider stages to reset same once during each period of the timekeeping signal $f_n$. Thus, $$\Delta t = \frac{1}{f_0}\sum_{i=0}^{i=k-1} 2^i,$$

and it is possible to add or subtract the $\Delta t$ from the high frequency time standard signal. Accordingly, gate circuit 6 has two functions, first, to gate the signals corresponding to $k$ stages corresponding to $\Delta t$ but not to pass the reset signals for $k+1$ the binary stage selectively reset for either addition or subtraction by error time interval $\Delta t$ by applying the reset signal thereto. Thus, regulation of the timekeeping signal is effected by observing the timekeeping signal counted by the timepiece and making the necessary correction by selectively opening and closing the gate circuits.

Figure 4A:
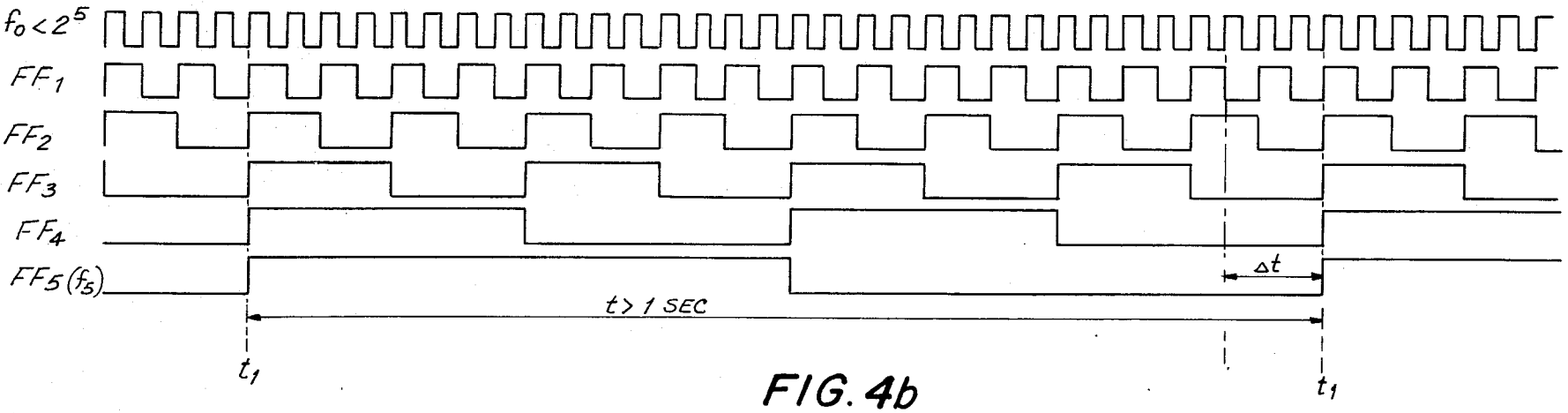
FIGS. 4*a* and 4*b* are wave diagrams illustrating the operation of the frequency regulating circuit depicted in FIG. 2.
Figure 4B:
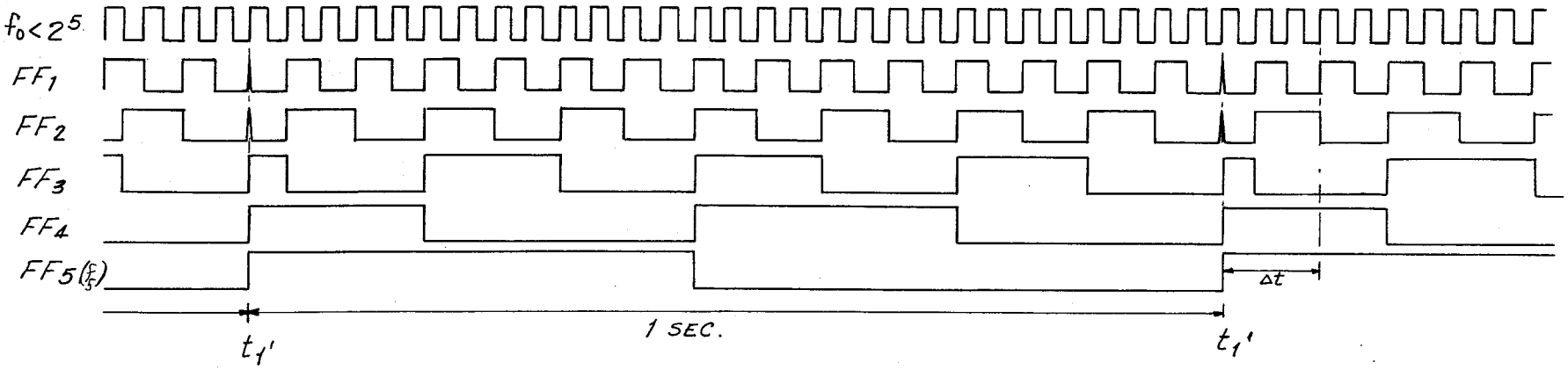

Reference is now made specifically to FIG. 4*a* and 4*b* wherein timing diagrams are utilized to explain the operation of the timekeeping signal adjustment circuit depicted in FIG. 2. Specifically, the timing chart in FIG. 5*a* represents the respective outputs of the five divider stages $FF_1$–$FF_5$ of an electronic timepiece having an input frequency $f_0$ of approximately $2^5$ Hz applied $2^5$ Hz applied to the five binary divider stages $FF_1$–$FF_5$ to produce a one second output signal a one second output signal $f_5$. When the time standard signal $f_0$ is less than $2^5$ Hz, as is illustrated in FIG. 5*a*, the period of the timekeeping function will become retarded. Accordingly, comparision of the seconds count of the timepiece to a time reference will provide an indication of the amount that is necessary to reduce each period of the timekeeping signal. As noted above, the period of the timekeeping signal can be shortened by a value $\Delta t$ which is equal to $$\frac{1}{f_0}\sum_{i=0}^{i=k-1} 2^i$$

once during each period of the timekeeping signal. As depicted in FIG. 4*b*, if the timekeeping signal is to be reduced by 3/32 of each period of the timekeeping signal, then $k = 2$ and gates $G_1$ and $G_2$ are opened to allow a reset signal R to be applied to the flip-flops $FF_1$ and $FF_2$ at the beginning of each period of the timekeeping signal output of the flip-flop stage $FF_5$ ($f_5$) which is advanced by 3/32 of the period of $f_5$.

Referring specifically to FIG. 4*a*, the period of timekeeping signal $f_5$ is greater than one second and begins each period by the coincident rise of the pulses at the same time t that each of the binary counters $FF_1$ to $FF_5$ and the frequency $f_0$ are advanced to the one state. Accordingly, as depicted in FIG. 4*b*, if binary divider stages $FF_1$ and $FF_2$ are reset at the beginning of each period $t_1$, each period is shortened by $\Delta t$, which equals $$\frac{1}{f_0}\sum_{i=0}^{i=k-1} 2^i$$

where $k = 1, 2, n-1$, which for the example depicted in FIG. 4*b*, $k =$ *and* $\Delta t = 3/32$ of the period of $f_5$.

It is noted that C-MOS integrated circuitry is clearly useable in the circuits and in the case of high frequency circuity, C-MOS-IC utilizing SOS techniques or Si-gate IC techniques is preferably used in order to reduce the gate-drain stray capacitances, a feature particularly preferred to achieve a high frequency response. Moreover, the reduced capacitance effected by the use of such integrated circuitry further reduces the power consumption because the difusion capacitance in the drain terminal is reduced and the MOS transistor is independently separated. Finally, because the frequency of the oscillator circuit need not be adjusted, the cost of manufacturing the vibrators utilized in the oscillator circuit is clearly reduced. Finally, as hereinabove noted, the higher the frequency of the oscillator circuit, the greater the accuracy at which frequency regulation can be effected.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. In an electronic timepiece including oscillator means for producing a high frequency time standard signal, divider means for producing an unregulated timekeeping signal in response to said high frequency time standard signal, said divider means including n series-connected divider stages, the frequency of said unregulated timekeeping signal being determined by the number of n series-connected divider stages, each of said n divider stages being adapted to produce an intermediate frequency signal representative of the count thereof, the improvement comprising, a first logic gate means for receiving at least one of said intermediate frequency signals and inverted intermediate frequency signals from each of said n series-connected divider stages, and in response to said of said intermediate frequency signals and said inverted intermediate frequency signals applied thereto having a coincident binary level, being adapted to apply a control signal to each of said divider stages to thereby adjust the count of each of said divider stages to the same binary level, and n second logic gate means respectively coupled intermediate said n series-connected divider stages and said first logic gate means, each of said second logic gate means being adapted to receive and select an intermediate frequency signal and applya predetermined number of said intermediate frequency signals produced by k series-connected divider stages, where $k = 0, 1, 2 \ldots, n-1$, to said first logic gate means, said second logic gate means being further adapted to invert and apply said intermediate frequency signals produced by said $k + 1$ through $n$ divider stages to said first logic gate means, and n third logic gate selecting means coupled respectively to each of said $n$ second logic gate means for selectively disposing a first plurality of $k$ second logic gate means associated with k series-connected divider stages, where $k = 1, 2, \ldots, n$-1, to directly apply said intermediate frequency signal to said first logic gate, said remaining n third logic gate selecting means being adapted to dispose each of said second logic gate means coupled to said $k + 1$ through n series-connected divider stages to invert said intermediate frequency signals applied thereto and, in turn, apply same to said first logic gate means, said intermediate frequency signals produced by said divider stages being applied as a first input to said respect second logic gate means and wherein a second input of each of said 1 through $n$ - 1 second logic gate means is the respective outputs of said 2 through $n$ third logic gates, the first input of said $n$th third logic gate means being referenced to a high binary level, and wherein the second input of each of said $n$ third logic gate means includes a select terminal, said $k$ select terminal being adapted to reference each of said inputs to $k$ third logic gate means, and in turn, $k$ second logic gate means to an open state to thereby apply each of said intermediate frequency signals produced by $k$ series-connected divider stages to said first logic gate means, said remaining $k + 1$ through n third logic gate select means being adapted to dispose each of said second logic gate means to which same are coupled to invert said intermediate frequency signals applied thereto.

2. An electronic timepiece as claimed in claim 1, wherein said first logic gate means is an AND gate, each of said second logic gate means are EXCLUSIVE OR gates, and each of said third logic gate means are AND gates.

3. An electronic timepiece as claimed in claim 1, wherein the error in the period of said unadjusted timekeeping signal, $$\Delta t = \frac{1}{f_0} \sum_{i=0}^{i=k-1} 2^i$$

where $f_0$ is the high frequency time standard signal and $n-k+1$ corresponds to the number of divider stages producing intermediate frequency signals that are inverted and then applied to the first logic gate means.

4. In an electronic timepiece including oscillator means for producing a high frequency time standard signal, divider means for producing an unregulated timekeeping signal in response to said high frequency time standard signal, said divider means including $n$ series-connected divider stages, the frequency of said unregulated timekeeping signal being determined by the number of n series-connected divider stages, being adapted to produce an intermediate frequency signal representative of a count thereof, the improvement comprising, a first logic gate means for receiving at least one of said intermediate frequency signals produced by said $n$ series-connected divider stages, and in response to each of said intermediate frequency signals applied thereto having a coincident binary level, being adapted to apply a control signal to each of said divider stages to thereby adjust the count of each of said divider stages to the same binary level, $n$ second logic gate means respectively coupled intermediate each of said n series-connected divider stages and first logic gate means, each second logic gate means being adapted to receive said intermediate frequency signal produced by said divider stage associated therewith, each said second logic gate means being disposed in one of an open state and a closed state for preventing a predetermined number of intermediate frequency signals produced by k series-connected divider stages, where $k = 0, 1, 2 \ldots, n - 1$, from being applied to said logic gate means, said remaining second logic gate means being disposed to apply the intermediate frequency signals produced by $k + 1$ through $n$ divider stages to said first logic gate, to thereby produce a regulated timekeeping signal, and including n third logic gate selecting means respectively coupled to each of said n second logic gate means for selectively disposing a first plurality of $k$ second logic gate means associated with said $k$ series-connected divider stages, where $k = 1, 2, \ldots, n - 1$, in a first state to prevent said intermediate frequency signals from being applied to said first logic gate, said remaining n third logic gate selecting circuit means being adapted to dispose the remaining second logic gate means coupled to said $k + 1$ through n series-connected divider stages in a second state to thereby apply said intermediate frequency signals received thereby to said first logic gate means so that said intermediate frequency signals produced by said divider stages are applied as a first input to said respective second logic gate means and wherein a second input of each of said 1 through $n - 1$ second logic gate means is the respective outputs of said 2 through $n$ third logic gate means, the first input of said nth third logic gate means being referenced to a high binary level, and wherein the second input of each of said $n$ third logic gate means includes a select terminal, said select terminals being adapted to reference each of the inputs of $k$ third logic gate means, and in turn, $k$ second logic gate means to a closed state to thereby prevent each of said $k$ intermediate frequency signals from being applied to said first logic gate means, said remaining $k + 1$ through $n$ third logic gate means being adapted to disposed each of said second logic gate means to an open condition to apply said intermediate frequency signals received thereby to said first logic gate means.

5. An electronic timepiece as claimed in claim 1, wherein said first logic gate means is a NOR gate, each of said second logic gate means are AND gates, and each of said third logic gate means are AND gates.

6. An electronic timepiece as claimed in claim 1, wherein the error in the period of said unadjusted timekeeping signal, $$\Delta t = \frac{1}{f_0} \sum_{i=0}^{i=k-1} 2^i,$$

where $f_0$ is the high frequency time standard signal and $n-k+1$ corresponds to the number of divider stages producing intermediate frequency signals that are applied to said first logic gate means.

* * * * *